US006036125A

United States Patent [19]

Morey et al.

[11] Patent Number: 6,036,125

[45] Date of Patent: Mar. 14, 2000

[54] WOOD CHIPPER

[75] Inventors: Michael Boyd Morey, Shepherd; Michael John Peterman, Alma; Brian Lee Bloomquist, St. Louis, all of Mich.

[73] Assignee: Tramor, Inc., Remus, Mich.

[21] Appl. No.: 09/219,729

[22] Filed: Dec. 22, 1998

[51] Int. Cl.[7] ..... B02C 18/22

[52] U.S. Cl. ..... 241/47; 241/101.76; 241/186.3

[58] Field of Search ..... 241/101.78, 47, 241/186.3, 189.1, 186.2, 101.76; 144/172, 174

[56] References Cited

U.S. PATENT DOCUMENTS

| | | | |
|---|---|---|---|
| 190,675 | 5/1877 | Gaines . | |
| 589,236 | 8/1897 | Williams . | |
| 604,283 | 5/1898 | Albrecht . | |
| 1,266,894 | 5/1918 | Williams . | |
| 1,713,507 | 5/1929 | Ammon . | |
| 1,752,290 | 4/1930 | Ammon . | |
| 1,889,129 | 11/1932 | Nielsen . | |
| 1,959,465 | 5/1934 | Dryfoos | 241/186.3 X |
| 2,026,790 | 1/1936 | Mankoff | 83/11 |
| 2,128,194 | 8/1938 | Sheldon | 83/11 |
| 2,244,577 | 6/1941 | Schreiber | 83/11 |
| 2,318,219 | 5/1943 | Harris | 83/11 |
| 2,392,958 | 1/1946 | Tice | 241/55 |
| 2,658,318 | 11/1953 | Miller | 56/501 |
| 2,663,505 | 12/1953 | Sennholtz | 241/197 |
| 2,678,169 | 5/1954 | Tullis | 241/186.3 X |
| 2,710,635 | 6/1955 | Alexander | 144/162 |
| 2,837,290 | 6/1958 | Nagel | 241/186.3 |
| 2,863,476 | 12/1958 | Clark | 144/172 |
| 2,864,420 | 12/1958 | Schmidt | 146/106 |
| 3,030,037 | 4/1962 | Raetz | 241/52 |
| 3,254,687 | 6/1966 | Tertyshnikov | 146/79 |
| 3,367,585 | 2/1968 | Ratkowski | 241/197 |
| 3,436,028 | 4/1969 | Koehnen et al. | 241/186 |
| 3,509,924 | 5/1970 | Newhouse, Jr. | 146/70.1 |
| 3,642,214 | 2/1972 | Blackwell, Jr. | 241/191 |
| 3,844,494 | 10/1974 | Hightower | 241/197 |
| 3,907,016 | 9/1975 | Nicholson et al. | 144/172 |
| 3,907,216 | 9/1975 | Mackissic et al. | 241/152.2 |
| 3,936,004 | 2/1976 | Graf et al. | 241/5 |
| 4,074,594 | 2/1978 | Dall et al. | 76/101 |
| 4,077,450 | 3/1978 | Ackerman | 144/172 |
| 4,117,985 | 10/1978 | Lazareck | 241/197 |
| 4,129,260 | 12/1978 | Baker | 241/46 |
| 4,146,184 | 3/1979 | Whitney | 241/73 |
| 4,162,769 | 7/1979 | Lapointe | 241/68 |
| 4,168,035 | 9/1979 | Palm et al. | 241/81 |
| 4,504,019 | 3/1985 | Newell et al. | 241/73 |
| 4,702,424 | 10/1987 | Widlak | 241/101.7 |
| 4,717,083 | 1/1988 | Quast et al. | 241/197 |
| 4,850,406 | 7/1989 | Krautzberger | 144/230 |
| 4,872,500 | 10/1989 | Duffey et al. | 164/34 |
| 4,915,310 | 4/1990 | Stelk | 241/197 |
| 4,917,314 | 4/1990 | Manschwetus | 241/194 |
| 4,922,977 | 5/1990 | Colton et al. | 144/230 |
| 4,967,969 | 11/1990 | Griffith, III | 241/93 |
| 4,982,904 | 1/1991 | Greiner | 241/73 |
| 5,042,727 | 8/1991 | Plante | 241/101.7 |
| 5,044,567 | 9/1991 | Hte et al. | 241/73 |
| 5,078,328 | 1/1992 | Willingham | 241/101.7 |
| 5,114,085 | 5/1992 | Inui | 241/195 |
| 5,205,496 | 4/1993 | O'Donnell et al. | 241/34 |
| 5,209,278 | 5/1993 | Carpenter et al. | 144/230 |
| 5,285,974 | 2/1994 | Cesarini | 241/194 |
| 5,362,004 | 11/1994 | Bateman | 241/290 |
| 5,372,316 | 12/1994 | Bateman | 241/191 |
| 5,377,919 | 1/1995 | Rogers et al. | 241/189.2 |
| 5,413,286 | 5/1995 | Bateman | 241/190 |
| 5,474,239 | 12/1995 | Williams, Jr. et al. | 241/73 |
| 5,526,988 | 6/1996 | Rine | 241/23 |
| 5,692,548 | 12/1997 | Bouwers et al. | 144/174 |

*Primary Examiner*—John M. Husar
*Attorney, Agent, or Firm*—Bliss McGlynn, P.C.

[57] ABSTRACT

A wood chipper includes a housing having an inlet and an outlet and a cutting assembly disposed within the housing between the inlet and the outlet and a chute disposed about and overhanging the outlet to form a space therebetween.

11 Claims, 2 Drawing Sheets

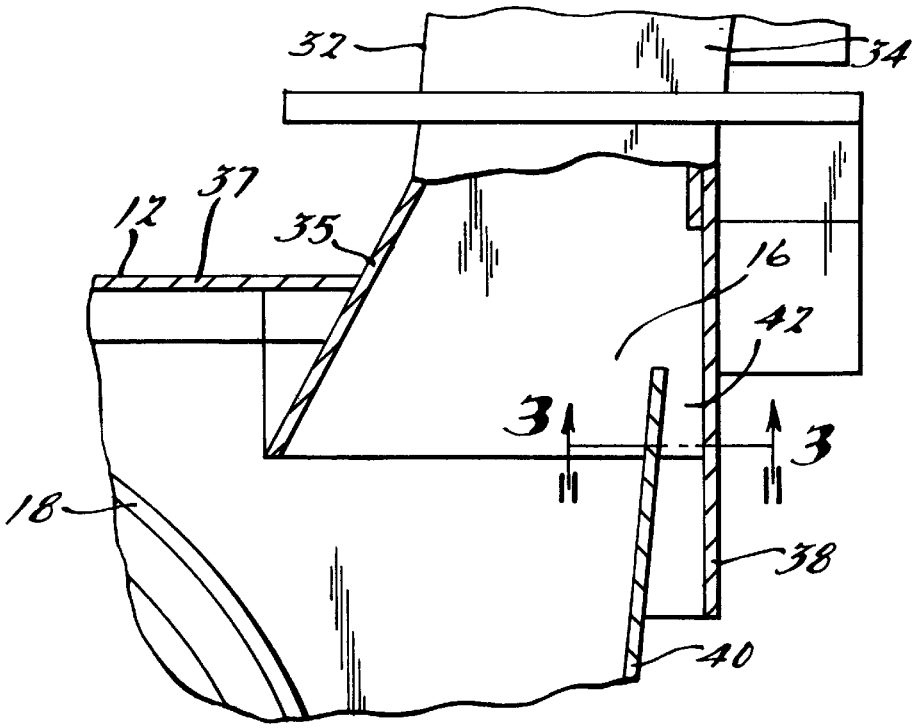
FIG. 2.
FIG. 3.
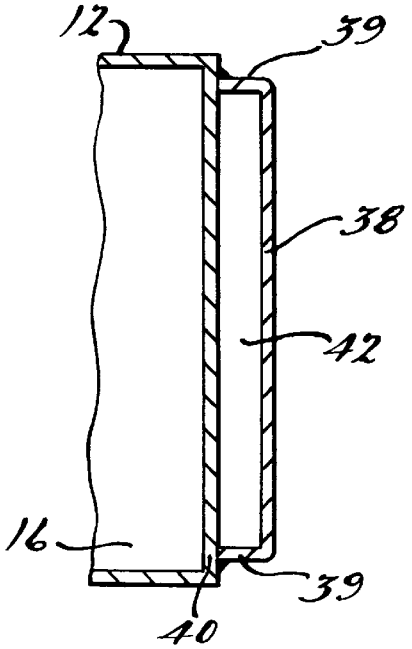
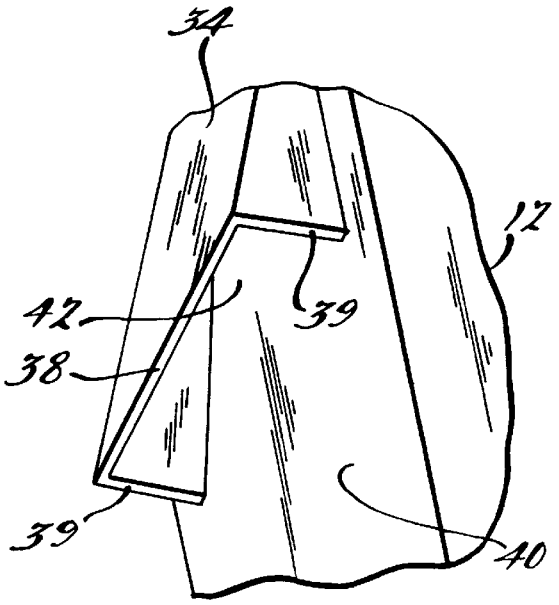
FIG. 4.

WOOD CHIPPER

BACKGROUND OF THE INVENTION

1. Field of the Invention

The present invention relates generally to wood chippers.

2. Description of the Related Art

It is known to provide a wood chipper for chipping wood such as brush, branches and the like to produce wood chips. One type of wood chipper known in the art includes a drum assembly having a rotatable drum with a knife or blade for chipping the wood entering the wood chipper and reducing it to wood chips. Typically, the wood chipper includes an outlet or discharge chute for allowing the wood chips from the drum assembly to exit the wood chipper. The chute is flush with an outlet of a housing for the drum assembly and extends upwardly and forwardly to discharge the wood chips past a hitch of the wood chipper. The chute may have a trap door, which is hinged to the chute to allow an operator to unplug the chute.

Although this type of wood chipper has worked well, it suffers from the disadvantage that the chute can become plugged under normal or extreme operating conditions. This may also result in the drum assembly becoming plugged with wood chips. Another disadvantage of the wood chipper is that, when the chute becomes plugged, it takes several hours to unplug the chute and/or drum assembly and resume operation of the wood chipper. Yet another disadvantage of the wood chipper is that dust may blow back on an operator infeeding wood into an inlet of the wood chipper.

SUMMARY OF THE INVENTION

Accordingly, the present invention is a wood chipper including a housing having an inlet and an outlet and a cutting assembly disposed within the housing between the inlet and the outlet and a chute disposed about and overhanging the outlet to form a space therebetween.

One advantage of the present invention is that a new and improved wood chipper is provided. Another advantage of the present invention is that the wood chipper is provided with a chute, which overhangs an outlet of a housing for a cutting assembly such as a drum assembly to prevent plugging of the wood chipper. Yet another advantage of the present invention is that the wood chipper has a chute overhanging an outlet of the cutting assembly to let air flow out of the chute and to prevent plugging of the chute and cutting assembly on in-feeding wood into the wood chipper. Still another advantage of the present invention is that the wood chipper has a chute overhanging an outlet of a cutting assembly to increase chipping power of the wood chipper. A further advantage of the present invention is that the wood chipper has a chute overhanging an outlet of a cutting assembly to prevent blow back of dust on in-feeding wood into the wood chipper.

Other features and advantages of the present invention will be readily appreciated as the same becomes better understood after reading the subsequent description when taken in conjunction with the accompanying drawings.

BRIEF DESCRIPTION OF THE DRAWINGS

FIG. 2 is an enlarged fragmentary elevational view of a portion of the wood chipper of FIG. 1.

FIG. 3 is a sectional view taken along line 3—3 of FIG. 2.

FIG. 4 is a perspective view of a portion of the wood chipper of FIG. 2.

DESCRIPTION OF THE PREFERRED EMBODIMENT(S)

Figure 1:
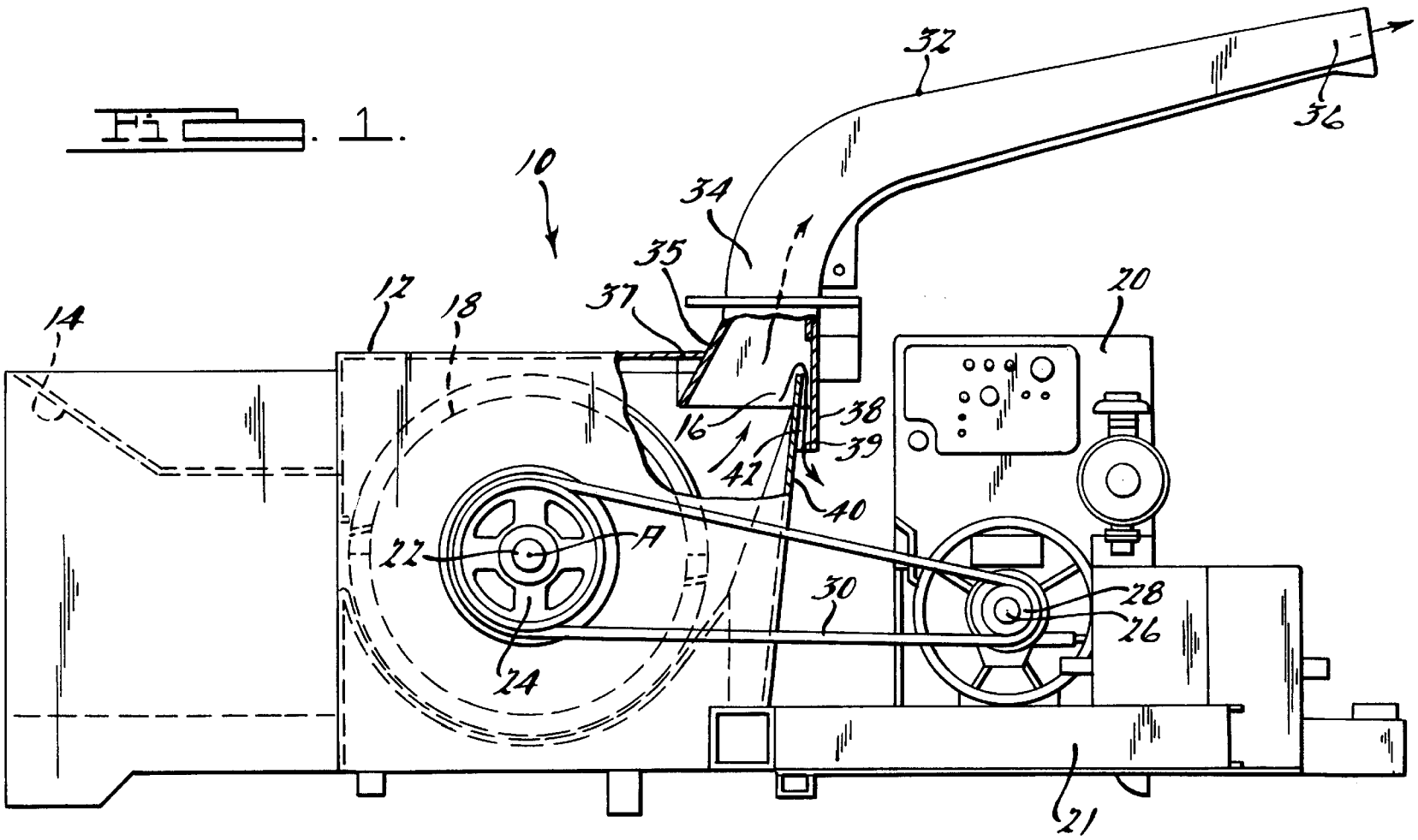
FIG. 1 is a fragmentary elevational view of a wood chipper, according to the present invention.

Referring now to the drawings and in particular FIGS. 1 and 2, one embodiment of a wood chipper 10, according to the present invention, is shown. The wood chipper 10 includes a housing 12 having an inlet 14 and an outlet 16. The wood chipper 10 also includes a cutting assembly such as a drum assembly 18 disposed within the housing 12 between the inlet 14 and outlet 16 for rotation about a horizontal axis A. The drum assembly 18 includes a rotatable drum having a plurality of pockets disposed circumferentially thereabout and a plurality of blades operatively connected to the drum with one of the blades partially overlapping one of the pockets. The drum assembly 18 is of the type disclosed in copending application, Ser. No. 09/218,491, filed Dec. 22, 1998, entitled "Drum Assembly For A Wood Chipper", the disclosure of which is hereby incorporated by reference.

The wood chipper 10 includes an engine 20 mounted on a frame 21 and coupled to the drum assembly 18 by suitable means to cause rotation of the drum assembly 18 about its axis A. The wood chipper 10 includes a rotatable shaft 22 operatively connected to the drum of the drum assembly 18 and a pulley 24 disposed about one end of the shaft 22. The shaft 22 is rotatably mounted to the housing 12 by suitable means such as bearings (not shown). The wood chipper 10 also includes a rotatable shaft 26 operatively connected to the engine 20 and a pulley 28 disposed about the shaft 26. The wood chipper 10 further includes a belt 30 disposed over and interconnecting the pulleys 24 and 28. It should be appreciated that the engine 20 rotates the shaft 26 and pulley 28, in turn, rotating the belt 30, pulley 24 and shaft 22, in turn, rotating the drum assembly 18.

Referring to FIGS. 1 through 4, the wood chipper 10 includes an outlet or discharge chute 32 disposed about the outlet 16 and operatively connected to the housing 12. The discharge chute 32 is generally tubular and may be circular or rectangular in cross-sectional shape. The discharge chute 32 has a lower end 34 and an upper end 36 extending upwardly and forwardly. The discharge chute 32 is made of a rigid material such as metal. It should be appreciated that the discharge chute 32 may have any suitable cross-sectional shape.

The lower end 34 of the discharge chute 32 is of a size proportional to the outlet 16 of the housing 12. The lower end 34 of the discharge chute 32 has a rear side wall 35 disposed partially within the outlet 16 and abutting a top wall 37 of the housing 12. Preferably, only one side, preferably a front side wall 38, of the lower end 34 overhangs a front wall 40 of the outlet 16 to form a gap or space 42 therebetween of a predetermined size, preferably approximately four inches. The front side wall 38 has side flanges 39 generally perpendicular thereto secured to the housing 12 by suitable means such as welding or bolting. The front side wall 38 of the lower end 34 is orientated generally vertical to the front wall 40 of the outlet 16 which extends upwardly at an angle. As a result, the outlet 16 communicates with the space 42 and allows larger wood chips which are to heavy to travel up the discharge chute 32 to fall in the space 42 therebetween and exit the wood chipper 10. The space 42 also allows air to flow out of the lower end 34 of the discharge chute 32 to prevent plugging of the drum assembly 18. It should be appreciated that the lower end 34 may have any suitable size to allow airflow out the upper end 36 and allow wood chips to fall out.

In operation of the wood chipper 10, the engine 20 rotates the drum assembly 18. Wood is fed into the inlet 14 of the housing 12 by an operator and is contacted by the drum assembly 18. As the drum assembly 18 rotates and contacts the wood, the wood is cut or chipped into wood chips, which are typically expelled axially. The drum assembly 18 includes fans (not shown) to help create airflow as indicated by the arrows to move the wood chips through the outlet 16 of the housing 12. The space 12 allows airflow out the bottom of the lower end 34 of the discharge chute 32. The wood chips are expelled out of the upper end 36 of the discharge chute 32 and yet wood chips are allowed to fall out of the space 42 if the discharge chute 32 attempts to start plugging. It should be appreciated that the drum assembly 18 does not become plugged, however, the drum assembly 18 may be stalled under normal operating conditions.

The present invention has been described in an illustrative manner. It is to be understood that the terminology, which has been used, is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. A wood chipper comprising:

a housing having an inlet and an outlet, said housing having a first wall forming a portion of said outlet;

a cutting assembly disposed within said housing between said inlet and said outlet; and a chute having a lower end disposed about said outlet with at least one second wall spaced from said first wall and overhanging said outlet to form a space of a predetermined size between said first wall and said at least one second wall communicating with said outlet.

2. A wood chipper as set forth in claim 1 wherein said first wall extends upwardly at an angle.

3. A wood chipper as set forth in claim 2 wherein said at least one second wall is orientated generally vertically to said first wall.

4. A wood chipper as set forth in claim 3 wherein said at least one second wall has flanges extending generally perpendicular thereto.

5. A wood chipper as set forth in claim 1 wherein said space is circular or rectangular in cross-sectional shape.

6. A wood chipper as set forth in claim 1 wherein said predetermined size of said space is approximately four inches in width between said at least one second wall and said first wall.

7. A wood chipper comprising:

a housing having an inlet and an outlet, said housing having a front wall forming a portion of said outlet;

a drum assembly disposed within said housing between said inlet and said outlet and rotatable about a horizontal axis; and a chute having a lower end disposed about said outlet with a front side wall spaced from said front wall and overhanging said outlet to form a space of a predetermined size between said front wall and said front side wall communicating with said outlet.

8. A wood chipper as set forth in claim 7 wherein said front wall extends upwardly at an angle.

9. A wood chipper as set forth in claim 8 wherein said front side wall is orientated generally vertically to said front wall.

10. A wood chipper as set forth in claim 9 wherein said front side wall has flanges extending generally perpendicular thereto.

11. A wood chipper comprising:

a housing having an inlet and an outlet, said housing having a front wall extending upwardly at an angle and forming a portion of said outlet;

a drum assembly disposed within said housing between said inlet and said outlet and rotatable about a horizontal axis; and a discharge chute disposed about said outlet and having a front side wall spaced from said front wall and orientated generally vertically to said front wall and overhanging said front wall of said housing to form a space of a predetermined size between said front wall and said front side wall communicating with said outlet.

* * * * *